United States Patent [19]

Striebig

[11] 4,181,054

[45] Jan. 1, 1980

[54] APPARATUS FOR CUTTING PANELS TO SIZE

[76] Inventor: Ludwig Striebig, Grossmatte, CH-6014 Littau, Switzerland

[21] Appl. No.: 895,517

[22] Filed: Apr. 11, 1978

[51] Int. Cl.[2] ..... B27B 5/06

[52] U.S. Cl. ..... 83/153; 83/453; 83/471.3; 83/477.1

[58] Field of Search ..... 83/477.1, 477.2, 471.3, 83/453, 153, 152, 487

[56] References Cited

U.S. PATENT DOCUMENTS 3,890,861 6/1975 Gebhardt ..... 83/453 X

*Primary Examiner*—J. M. Meister

*Attorney, Agent, or Firm*—Toren, McGeady and Stanger

[57] ABSTRACT

Panel cutting apparatus in which a supporting structure defines a vertically extending surface of engagement with a panel to be cut, a panel edge rest downwardly bounds the surface, a saw carrier is guided on the structure for horizontal movement along the surface, a saw unit may be moved vertically on the carrier in sawing engagement with a panel in the surface of engagement, and an improved gripping arrangement for gripping a vertically extending side edge portion of the panel includes a slide guided on the supporting structure in a vertically extending path, a pair of clamping jaws on the slide, and a moving device for moving respective clamping faces of the jaws toward and away from each other into and out of clamping engagement with the side edge portion of the panel.

13 Claims, 2 Drawing Figures

APPARATUS FOR CUTTING PANELS TO SIZE

Figure 1:
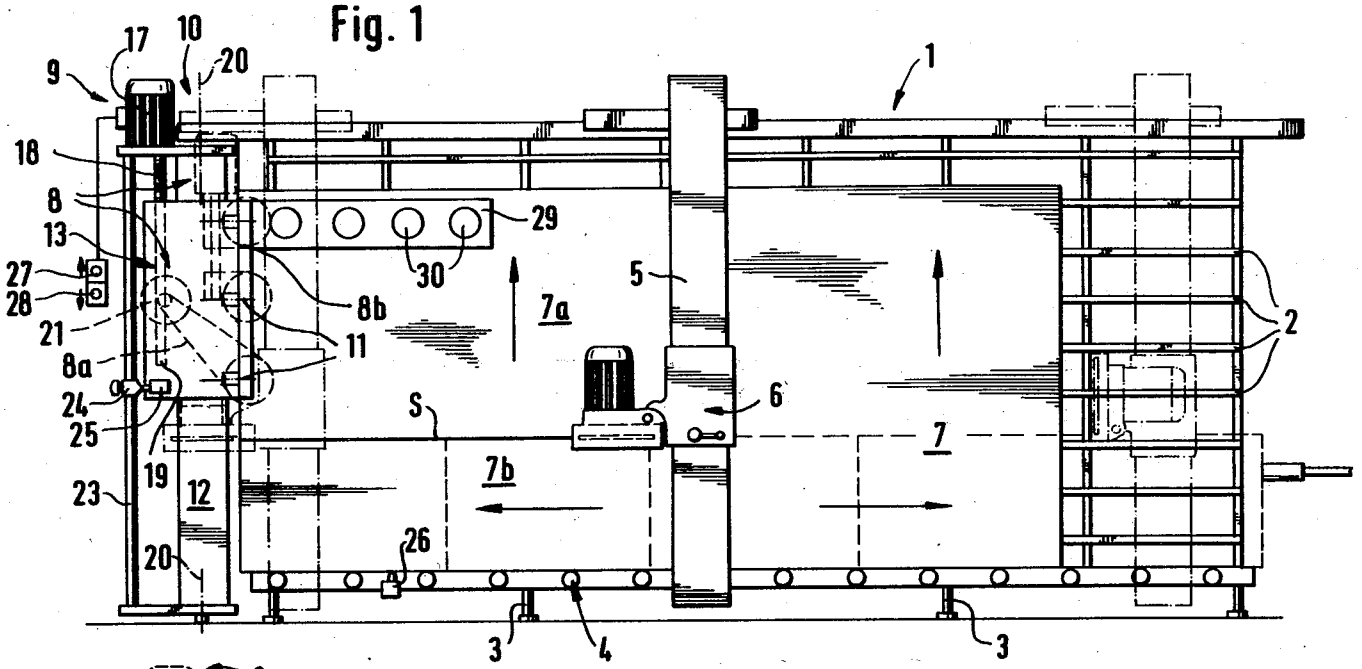

The invention relates to apparatus for cutting panels to size, such as panels of chipboard, plywood, plastic, and the like, and comprising an approximately vertically disposed frame structure with a supporting grid as an area of engagement for horizontal and vertical cutting to size of the panels which are to be deposited on a horizontal panel edge rest, a carrier bar for a saw with movably mounted saw unit, as well as a device for engagement with vertically extending edges of panels to be cut or panel portions not yet cut and for thereby securing the same.

Cutting to size is carried out in a known apparatus (German Pat. No. 2,305,673) in such a manner that one of the longitudinal edges of a panel extending in an approximately vertical plane is set on a horizontal panel edge rest, and thereafter a longitudinal strip is severed first from the lower part of the panel bounded by the lower edge rest, whereas the remainder of the panel above the cutting line is held fast at a distance from the edge rest defined at least by the cutting line until the lower, severed, longitudinal strip has been processed further into the workpieces to be made therefrom and has been removed from the edge rest. Thereafter, the secured, upper panel portion may be lowered to the panel edge rest and a new horizontal, longitidinal cut may be started.

The known apparatus employed in this mode of operation for engaging and securing the edge portions of the panels is a clamping device slidably guided on the frame structure and operable for engaging the two opposite, vertically extending lateral edges of a panel and for holding them firmly clamped practically from two sides. The clamping elements of the clamping device are adjustable as to their height so that they may be set under all conditions in an area above an intended cutting line whereby the panel portion to be severed is accessible without interference over its entire length. However, as long as the known clamping elements engage the two side edges of the panel, the panel material can only be sawn horizontally and in those surface sections which are located below the clamping elements. If one were to perform a horizontal cut above the clamping range of the known securing means, for example, the weight of the panel portion located above the cut would cause the width of the saw cut to be reduced gradually so that only a poorly defined cut could be achieved if the sawing operation can be completed at all. If one were to perform a vertical cut in the panel material clamped on two sides, similar interference with the cutting operation would have to be expected because oppositely directed components of force caused by the clamping elements always occur when the vertical, lateral edges are clamped fast. Particularly, it is impossible with the known device further to process small panel sections, or to sever narrow vertical strips because a supporting grid with narrow spacing cannot be installed.

When panels of large surface area are to be divided by sawing, it is known to be necessary for a minimum of scrap losses and thus an economical use of the material that the individual cuts are planned precisely before the sawing process is started. It is found frequently that it would be most advantageous to sever first several vertical strips from a large panel, and thereafter to subdivide the remaining portion of the panel by additional horizontal and vertical cuts. If the operation of the known apparatus is to be based on cuts plotted in the described manner, it would be necessary to remove the clamping elements engaging the lateral edges and to secure them again for each vertical cut to be performed which obviously would cause a high labor cost.

It is also known that the edge zones of the panels to be processed contain more or less moisture than the central zones. This difference in the moisture distribution within a panel creates internal stresses which are released when the panel is sawed apart. This results in warping of the panel sections, particularly their opposite surfaces bounding the cut may be deformed arcuately. Because a saw blade generally has a thickness of only about 3 mm, it is usually necessary to lift the upper panel section slightly for an unimpeded movement of the lower panel section which is to be shifted laterally. Such separate lifting of the upper panel section also is not capable of being performed readily by means of the known apparatus.

It is the object of this invention to provide a device for engaging and securing the vertical, lateral edges of the panel material to be processed in apparatus for cutting panels to size in such a manner than universal cutting of the desired workpieces from the panel material is possible. Additionally, the device is to be of simple structure, reliable in its operation, easily inspected, and safe to operate, and also capable of being installed as a supplemental component in vertical panel saws already in use without requiring great changes to be performed.

This object is achieved in apparatus of the type initially defined by an arrangement including a guide column at one of the lateral sections of the frame structure, and a slide movable relative to the column which carries a clamping jaw arrangement having clamping faces capable of firmly engaging a section of the vertically extending edge of a panel in parallel action.

The panel material to be processed, that is, an individual panel, several panels superimposed in area contact, or panel portions may be engaged and secured by this device according to the invention, for example, in such a manner that the slide is shifted to a position above a horizontal cut to be carried out, and that its clamping jaw arrangement is engaged with the upper portion of the side edge of the panel, and the clamping faces are clamped fast. Thereafter, the desired horizontal cut as well as further horizontal and vertical cuts may be carried out on the fixedly secured panel because the panel is accessible practically freely from three edges. Moreover, the vertical position of the clamped panel relative to the support grid may be changed at will by shifting the slide on its guide column without any need for releasing the clamping pressure on the panel or for engaging the clamping jaws in offset relationship.

According to a preferred embodiment, the guide column, as viewed in a direction toward the working surface, is arranged behind the latter and approximately parallel to the orientation of the saw carrier bar, the slide is guided on the guide column parallel to the direction of movement of the saw unit along the carrier bar, and the jaw of the pair of clamping jaws which extends into the working surface is provided with a vertical panel abutting face. It is an advantage of this embodiment that the sections located laterally of the frame structure do not interfere with lateral shifting of the panel portions beyond the working surface because the guide column is located behind the working surface.

According to another advantageous feature, the guide column may be arranged at the frame structure for pivoting movement about its longitudinal central axis so that the guided slide is swung together with the guide column during pivoting movement of the column. This swinging movement is advantageous particularly when a panel is to be lifted by means of the clamping jaw arrangement from a transport vehicle positioned next to the frame structure, and to be swung to the working surface of the supporting grid.

The slide of the apparatus according to the invention may be shifted vertically by a positioning drive, such as a motor-driven spindle cooperating with a spindle guide on the slide so that the slide may be adjusted quickly to any desired height along the guide column without manual effort. The positioning drive may be equipped to be operated in both directions or stopped in predetermined sections of its feed movement by suitable controls.

According to a further embodiment of the invention, the side of the slide directed toward the working surface on the support grid is equipped with a projecting, arm-like gripping device capable of being placed in area contact on an outer surface of a panel resting on the working surface and of being attached thereto. The supporting action of the panel abutment face is further enhanced by such a gripping device so that unusually large and heavy panels or panel portions can be fixed reliably with the assistance of the gripping device. More specifically, the gripping device may be of small width at right angles to the working surface so that it does not interfere with shifting movement of the saw carrier along the frame structure. The attachments may be several suction cups capable of being set on the panel surface.

Further features of the invention are defined in the claims depending from the principal patent claim.

Figure 2:
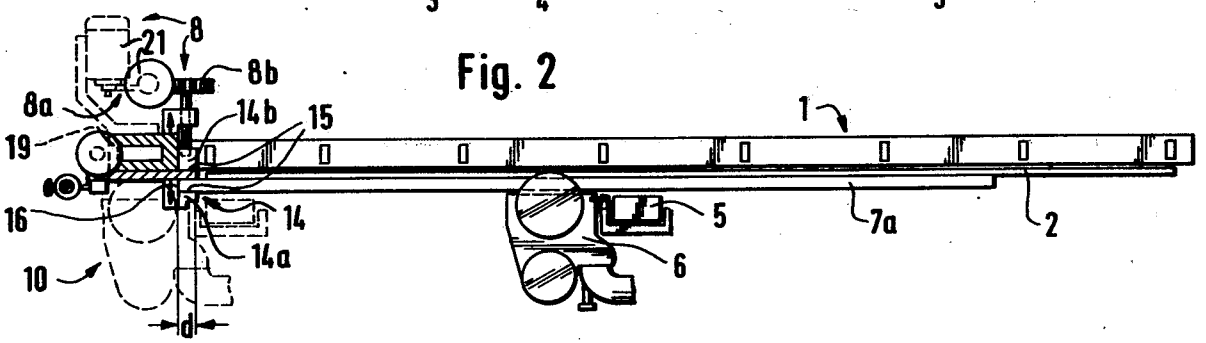

An embodiment of the invention will be described in detail hereinbelow with reference to the drawing in which:

FIG. 1 is a front elevational view of a schematically illustrated apparatus for cutting panels to size according to the features of the invention; and FIG. 2 is a top plan view of the apparatus of FIG. 1.

The apparatus illustrated in FIGS. 1 and 2 includes a frame structure 1, a supporting grid connected thereto and providing an area support for horizontal and vertical cutting to size of the panel material, and a row of legs 3 on which the frame structure 1 rests. A horizontal panel edge rest 4 is constituted by a row of lower supporting rolls on which the lower edge of panel 7 may be shifted easily along the supporting grid 2 after release of the rolls, if necessary. A saw carrier bar 5 is guided longitudinally on the frame structure, and a saw unit 6 is supported, also movably, on the bar. This saw unit may be moved vertically along the saw carrier bar 5 for performing vertical cuts while the saw unit is in an angular position relative to the carrier bar 5 as indicated at the right edge of the frame structure 1 in FIG. 1. For performing horizontal cuts, the saw unit 6 must be tilted relative to the saw carrier bar 5 until it assumes the position shown approximately in the center of FIG. 1, and may then be shifted jointly with the saw carrier bar 5 in the direction of elongation of the working surface. Details of the structure described above are evident, for example, from Austrian Pat. No. 231,690.

When the panel 6, for example, a chipboard panel, is to be divided horizontally along a cutting line S into an upper panel portion 7*a* and a lower panel portion 7*b*, it is necessary so to fix the upper panel portion 7*a* at least during the severing step that it cannot sink under its own weight and thereby narrow the saw cut. At the left lateral section of the frame structure 1, as viewed in the drawing, there is provided a device 10 for gripping and fixing the vertical lateral edge of the upper panel portion 7*a*. The device includes a guide column 12 and a slide 13 movable relative thereto. The edge portion of the column directed toward the panel 7 carries a clamping jaw arrangement 14 having clamping faces 15 which may be superimposed firmly in parallel action on a section d (FIG. 2) of the vertical edge of the panel portion 7*a*. As is seen particularly in FIG. 2, the guide column 12 which is of rectangular cross section is located behind the working surface defined by the grid 2, as viewed in the direction of FIG. 1, and is also parallel to the orientation of the saw carrier bar 5 and correspondingly inclined relative to the frame structure 1 so that lateral shifting of the lower panel portion 7*b* beyond the left edge of the frame structure 1 is not impeded in any way by the guide column 12. The slide 13 is also guided on the guide column parallel to the direction of displacement of the saw unit 6 along the saw carrier bar 5, and its clamping jaw arrangement 14 is designed in such a manner that one clamping jaw 14*a* projects into the working surface at the supporting grid 2 and thereby may reach around the panel edge whereas the other clamping jaw 14*b* may press from behind the supporting grid 2 against the edge of the panel 7. The clamping jaw 14*a* carries a vertical panel engaging abutment face 16 approximately perpendicular to its clamping face 15, and a panel may be moved laterally into the opened clamping jaw arrangement to the abutment face. Because of the afore-described parallel orientation of the guide column 12 relative to the saw carrier bar 5 and the corresponding guiding of the slide 13, the abutment face 16 for the panel is practically perpendicular to the horizontal panel edge rest 4.

The guide column 12 is arranged on the frame structure 1 for pivotal movement about its longitudinal, central axis 20, whereby, during pivoting column movement about this axis 20, the slide 13 and the clamping jaw arrangement 14 also are pivoted. Because of this angular mobility, the clamping jaw arrangement 14 may grip a panel 7 positioned at an angle to the working surface and subsequently swing the panel or a panel portion to the supporting grid 2, which may be followed by a lowering to the horizontal panel edge rest 4.

Vertical movement of the slide 13 along the guide column 12 is actuated by a positioning drive 9 which, as shown in FIG. 1, includes a lifting motor 17 arranged at the upper side of the guide column 12 and from which a spindle 18 extends which cooperates with a spindle guide 19 formed on the slide so that the slide 13 is lifted or lowered along its path on the guide column 12 when the spindle 18 turns. An upright control rod 23 is located to the left of the guide column 12 (FIG. 1) and guides a feed limiting abutment element 24 which may be set at any desired level along the path of movement of the slide 13. This feed limiting abutment element 24 cooperates with a feed-limiting abutment 25 mounted on the slide 13 and moving with the latter. Additionally, a lift-limiting abutment 26 is provided at the horizontal panel edge rest 4 and is connected with the positioning drive 9 as is the feed-limiting abutment 25.

When the positioning drive 9 receives a signal for upward movement of the slide 13 upon actuation of a switch 27 diagrammatically indicated in FIG. 1, the slide 13 is moved upward until the feed-limiting abutment 25 engages the abutment element 24 whereby a switch associated with the feed limiting abutment deenergizes the lifting motor 17. Simultaneously, the drive 8 of the clamping jaw arrangement 14 may be actuated by this feed-limiting abutment 25 to close the clamping jaws 14*a*, 14*b*. The drive 8 may also be actuated by a switch separate from the feed-limiting abutment 25. As soon as the panel 7 is anchored firmly on the frame structure 1 or on the working surface of the supporting grid 2, the cutting process may start. After complete severing of the panel 7 into the panel portions 7*a*, 7*b*, the slide 13 at first is shifted slightly upward together with the clamped upper panel portion 7*a*, whereby the lower panel portion 7*b* is completely set free and may be withdrawn from the supporting grid 2 toward the right or left. If the upper panel portion 7*a* firmly held by the clamping jaw arrangement 14 is to be lowered to the horizontal panel edge rest 4, for example, for further working, an additional switch 28 is actuated to furnish a lowering signal to the liftiing motor 17. This lifting motor 17 permits the slide 13 to slide downward along the guide column 12 until the lower edge of the upper panel portion 7*a* defined by the cutting line S engages the horizontal panel edge rest 4. At this moment, the lift-limiting abutment 26 arranged on the panel edge rest 4 is actuated, stops the lowering action of the lifting motor 17, and simultaneously furnishes a signal to the drive 8 of the clamping jaw arrangement 14 for opening the clamping jaws 14*a*, 14*b* whereby they release again the edge d of the upper panel portion 7*a*. As during the aforedescribed closing step of the clamping jaw arrangement 14, opening thereof may also be controlled by a switch separate from the lift-limiting switch 26.

The clamping jaws 14*a*, 14*b* are guided adjustably in parallel, spaced relationship on the slide 13, as is best seen in FIG. 2. Either both clamping jaws are movably mounted on the slide 13, or one clamping jaw is fixedly mounted, and the other clamping jaw is guided for movement relative to the fixed jaw. The clamping action of the clamping jaw arrangement 14 may be exerted by means of a row of three spindles 11 engaging one or both clamping jaws which they engage longitudinally in several sections and are guided in the slide 13. One of, the spindles 11 may be actuated by a drive chain 8*a* extending from a drive motor 21. Two of the spindles are connected with a common drive motor 21 by a worm drive 8*b*. Instead of the drive chain 8*a* other motor transmitting elements, such as cog belts and the like may be employed. Furthermore, the clamping jaws may be provided with a pressure-fluid drive, an electromagnetic drive, and the like.

The several drives 8, 9 and their operating cycles are controlled by means of conventional elements whose structural details are adapted to specific structural conditions.

As has been shown in FIG. 1 only, the device 10 is equipped with a supplemental gripping arrangement which is constituted by an arm-shaped gripper 29 projecting from the slide 13. This gripper 29 is fastened to the upper end of the slide 13, as viewed in FIG. 1, and extends from the slide 13 into the working surface at the supporting grid 2. Several vacuum-operated suction cups 30 are provided on its wide face directed toward the working surface and may be pressed against the smooth surface of a panel. The entire gripper has such a small width perpendicularly to the working surface that it is spaced from the top surface of the panel a distance smaller than the clearance between the saw carrier bar 5 and the top surface of the panel. The gripper 29 thus permits unhindered displacement of the saw carrier bar 5 along the supporting grid 2, and thereby an extension of the sawing stroke to the left edge (FIG. 1) of the supporting grid as shown by a representation of the saw elements in broken lines.

The most important working steps which follow each other during a sawing operation performed by means of the described apparatus will be summarized below:

A panel 7 is positioned first on the horizontal panel edge rest 4 and shifted toward the left, as viewed in FIG. 1, until its vertical edge engages the abutment face 16 of the opened clamping jaw arrangement 14. Thereafter, the saw of the saw unit 6 is set to the desired level for severing a horizontal strip, and the abutment element 24 is also clamped fast on approximately the same level on the control rod 23. With the clamping jaw arrangement 14 still open, the slide 13 is moved upward until the feed limiting abutment 25 is actuated, whereby the necessary distance between the bottom of the slide 13 and the horizontal panel edge rest 4 necessary for performing the sawing process from the left to the right or vice versa is cleared. After severing of the first horizontal strip, the slide 13 together with the firmly clamped and gripped panel portion 7*a* is moved slightly upward, and the severed longitudinal strip may now be divided into vertical work pieces after pivoting of the saw unit 6, or it may be withdrawn laterally over its entire length from the frame structure 1. After the panel portion 7*b* is removed, the panel portion 7*a* may be lowered to the horizontal panel edge rest 4 where the lift-limiting abutment 26 terminates the downward movement of the slide 13, simultaneously opens the clamping jaw arrangement 14, and causes the slide 13 with opened clamping jaws again to move upward to the abutment element 24.

I claim:

1. In apparatus for cutting panels including a supporting structure defining a vertically extending surface of engagement with a panel to be cut, a horizontally extending panel edge rest downwardly bounding said surface, a saw carrier movable on said structure in a predetermined direction substantially parallel to said surface, a saw unit movable on said carrier in a direction transverse to said predetermined direction in sawing engagement with a panel to said surface, and gripping means for gripping a vertically extending side edge portion of said panel, the improvement in said gripping means which comprises:

(a) guide means on said supporting structure defining a vertically extending path substantially parallel to said transverse direction, said guide means including
  (1) a guide column, said guide column and said saw unit being offset from said surface in opposite directions, and
  (2) pivot means securing said guide column to said structure for angular movement about a vertically extending axis;
(b) a slide member guided in said path by said guide means; and
(c) clamping means on said slide member including two clamping face portions; and
(d) moving means for moving said face portions toward and away from each other into and out of clamping engagement with said side edge portion.

2. In apparatus as set forth in claim 1, said moving means including at least one motor, said face portions being substantially planar and parallel to each other while being moved by said motor.

3. In apparatus as set forth in claim 2, wherein said moving means further include a plurality of elongated engaging elements vertically spaced on said slide member, and motion transmitting means connecting said elements to said at least one motor for longitudinal engagement of said elements with respective sections of one of said face portions, and for thereby moving said one face portion relative to said slide member.

4. In apparatus for cutting panels including a supporting structure defining a vertically extending surface of engagement with a panel to be cut, a horizontally extending panel edge rest downwardly bounding said surface, a saw carrier movable on said structure in a predetermined direction substantially parallel to said surface, a saw unit movable on said carrier in a direction transverse to said predetermined direction in sawing engagement with a panel in said surface, and gripping means for gripping a vertically extending side edge portion of said panel, the improvement in said gripping means which comprises:

(a) guide means on said supporting structure defining a vertically extending path;

(b) a slide member guided in said path by said guide means; and (c) clamping means on said slide member including two substantially planar clamping face portions; and (d) moving means for moving said face portions in substantially parallel relationship toward and away from each other into and out of clamping engagement with said side edge portion, said moving means including (1) at least one motor, (2) a plurality of elongated engaging elements vertically spaced on said slide member, and (3) motion transmitting means connecting said elements to said at least one motor for longitudinal engagement of said elements with respective sections of one of said face portions, and for thereby moving said one face portion relative to said slide member.

5. In apparatus as set forth in claim 4, wherein said transverse direction is substantially parallel to said path, said guide means include a guide column, said guide column and said saw unit being offset from said surface in opposite directions.

6. In apparatus as set forth in claim 5, pivot means securing said guide column to said structure for angular movement about a vertically extending pivot axis.

7. In apparatus as set forth in claim 4, the motion transmitting means connecting one of said elements to said at least one motor including a drive chain.

8. In apparatus as set forth in claim 4, the motion transmitting means connecting two of said elements to said at least one motor including a worm drive.

9. In apparatus for cutting panels including a supporting structure defining a vertically extending surface of engagement with a panel to be cut, a horizontally extending panel edge rest downwardly bounding said surface, a saw carrier movable on said structure in a predetermined direction substantially parallel to said surface, a saw unit movable on said carrier in a direction transverse to said predetermined direction in sawing engagement with a panel in said surface, and gripping means for gripping a vertically extending side edge portion of said panel, the improvement in said gripping means which comprises:

(a) a guide member defining a vertically extending path;

(b) a slide member mounted on said guide member for movement in said path;

(c) clamping means secured on said slide member for clamping said side edge portion of said panel to said slide members; and (d) mounting means movably mounting said guide member on said supporting structure for movement of a panel clamped by said clamping means toward and away from said surface of engagement when said guide member moves on said supporting surface.

10. In apparatus as set forth in claim 9, drive means operatively connected to said slide member for shifting said slide member in said path.

11. In apparatus as set forth in claim 10, said drive means including a threaded spindle elongated in the direction of said path, said spindle threadedly engaging said slide member, rotating means for rotating said spindle, and cooperating abutment means on said structure and on said slide member operatively connected to said rotating means for inactivating said rotating means and for thereby limiting movement of said slide member.

12. In apparatus as set forth in claim 9, an arm projecting horizontally from said guide member and carrying a gripper element.

13. In apparatus as set forth in claim 12, said arm being interposed between said supporting structure and said surface, and said gripper element being a suction cup directed toward said surface.

* * * * *